US005359352A

United States Patent [19]

Saita et al.

[11] Patent Number: 5,359,352

[45] Date of Patent: Oct. 25, 1994

[54] DRIVING METHOD OF HEAT GENERATING RESISTOR IN HEAT RECORDING DEVICE

[75] Inventors: Yoshiaki Saita; Norimitsu Sanbongi; Yoshinori Sato, all of Tokyo, Japan

[73] Assignee: Seiko Instruments Inc., Japan

[21] Appl. No.: 682,917

[22] Filed: Apr. 9, 1991

[30] Foreign Application Priority Data

Apr. 9, 1990 [JP] Japan ..... 2-94768
Apr. 9, 1990 [JP] Japan ..... 2-94769

[51] Int. Cl.[5] ..... B41J 2/35
[52] U.S. Cl. ..... 347/62; 346/76 PH
[58] Field of Search ..... 346/76 PH, 1.1; 400/120

[56] References Cited

U.S. PATENT DOCUMENTS 4,149,171 4/1979 Sato et al. ..... 346/1.1

FOREIGN PATENT DOCUMENTS 0267567 5/1988 European Pat. Off. .

OTHER PUBLICATIONS

Patent Abstracts of Japan, vol. 14, No. 186 (M-962) (4129), Apr. 16, 1990.
Patent Abstracts of Japan, vol. 12, No. 27 (M-662) (2874), Jan. 27, 1988.
Patent Abstracts of Japan, vol. 10, No. 191 (M-495) (2247), Jul. 4, 1986.
Patent Abstracts of Japan, vol. 14, No. 172 (M-958) (4115), Apr. 4, 1990.

*Primary Examiner*—Benjamin R. Fuller
*Assistant Examiner*—Huan Tran
*Attorney, Agent, or Firm*—Bruce L. Adams; Van C. Wilks

[57] ABSTRACT

A method of driving heating resistors in a thermal recording apparatus comprising dividing a plurality of heating resistors into a plurality of separate blocks. The heating resistors in the blocks are driven by sequentially applying a pulse to each block to generate heat sequentially, whereby a current which is generated in the heating resistors by means of application of a constant voltage pulse changes from a first state with a large current to a second state with a small current in a stepwise-like manner within a pulse application time, and the plurality of blocks are sequentially driven so that the first state with a large current within the pulse application time of one block does not coincide with the first state within the pulse application time of another block. Also, the plurality of blocks may be sequentially driven so that the second state with a small current within the pulse application time of one block coincides with the first state with a large current within the pulse application time of a block which is next applied with a pulse.

6 Claims, 11 Drawing Sheets

DRIVING METHOD OF HEAT GENERATING RESISTOR IN HEAT RECORDING DEVICE

BACKGROUND OF THE INVENTION

The present invention pertains to a heat recording method, such as heat sensitive recording, heat transcription recording, conduction heat sensitive recording, conduction transcription recording, thermal ink jet printing and the like. More particularly, the present invention pertains to a driving method for driving heat generating resistors in a heat recording device.

Conventional heat recording methods are known in which heat generated by heat generating resistors of a thermal head is transmitted directly to a heat sensitive paper and the like. Also, in a thermal ink jet system, bubbles are produced by heat generated from heat generating resistors of a thermal head. These bubbles create a pressure which results in the liquid ink jet used for printing. In these conventional heat recording methods, metal compound resistors made of ruthenium oxide, tantalum nitride are known. Also, such thermal resistors may include an insulating material having a high melting point such as silicon oxide and tantalum.

When a voltage is applied to the conventional heat generating resistors of the conventional thermal head, electric current passes through the heat: generating resistor to generate Joule heat. By maintaining this voltage for a predetermined time, the heat energy necessary for recording is applied to the recording medium. The Joule heat energy generated in the conventional heat generating resistor is determined by the resistance value of the resistor, the applied voltage, and the time duration that the voltage is applied. Conventionally, the characteristics of the conventional heat generating resistor have been controlled depending on various factors, such as the characteristics of the heat sensitive paper used, heat transmitting characteristics between the resistor and the paper, background temperature, the temperature of the recording medium, etc. The applied voltage or the duration of the voltage application is conventionally regulated in order to obtain the most suitable recording quality.

In another conventional recording method, known as the electric conduction transcription recording method, an ink donor sheet or the like is used which has an electric conduction heat generating resistance layer which may be made of a carbon paint. An electric conduction head is used to pass current to the electric conduction heat generating resistance layer which heats the ink on the ink donor sheet causing it to heat or sublime so that it can be applied to a recording medium. As with the other conventional recording methods, it is desirable to optimize the printing obtained by this method. Thus, the characteristics of the electric conduction heat generating resistance layer are controlled to optimize the printing results.

In the conventional heat recording methods, the printing results are sought to be optimized by controlling the heat energy of the recording device by adjusting the applied voltage and the voltage applying pulse width. However, controlling the applied voltage and voltage applying pulse width is extremely difficult resulting in recording instruments which are large and expensive.

The Joule heat energy generated by the voltage pulse applied to the heat generating resistor can be controlled by controlling the voltage or controlling the pulse width. However, the temperature obtained by the heat generating resistor is inconsistent and changes due to the application period of the voltage applying pulses, the number of continuously applied pulses, the proximity of other heat generating resistors, the temperature of the supporting substrate of the thermal head, the temperature of the ink donor sheet and the liquid ink, ambient temperature and other factors.

The magnitude of the heat energy generated by the heat generating resistor depends on the temperature of a color generating layer in the heat sensitive paper and the temperature of the ink layer. Also, it depends on the temperature of the heat generating resistor. Thus, in order to obtain a uniformly recorded heat recording, it is desirable to provide a temperature which is uniform. To make the temperature uniform it must first be determined what adjustment of the voltage or of the voltage application pulse width must be made so that the heat generated by the heat generating resistor is consistent and rises to a specified temperature. Thus, thermal environmental information must be collected or assumed and thermal history information of the heat generating resistor must be determined.

Such information collecting means, assuming means, and recording condition determining means are extremely expensive and require various kinds of temperature sensors for detecting the temperature of the thermal head substrate and ambient temperature. Also, memories for recording the recorded data of the heat generating resistor history, simulators such as a CPU for effecting arithmetic treatment, gate circuits, etc. are required. Furthermore, extremely complicated software must be utilized to obtain meaningful results. In particular, when a large sized high precision heat recording device which has a large number of heat generating resistors is used, such information collecting means, assuming means and recording condition determining means become extremely expensive and often times the recording quality is sacrificed. Furthermore, the time required to collect and determine the information is restricted by the CPU and has become an obstacle to high speed recording.

A glaze layer has been used on a thermal head as a temperature preserving layer for enhancing heat efficiency in general. However, this glaze layer is made by a thick film process and the fluctuation of the thickness reaches more than plus or minus 20% of an average value. Thus, the heat preserving effect of this glaze layer in each individual thermal head fluctuates greatly. Thus, the information collecting means, assuming means and record condition determining means used for heat generation temperature control at a high precision cannot be realized because of the fluctuation of characteristics of each individual thermal head. The fluctuation of thermal characteristics of each individual thermal head must be taken into consideration as a control parameter, which greatly sacrifices the ability of mass producing such thermal heads. Furthermore, the interchangeability of the thermal head of a recording instrument is sacrificed because of this need to adjust the individual characteristics of each thermal head. In the case of current passing heat recording, the same fluctuation of the heat capacity and heat resistance exists in the circumferential part of the heat generating resistance layer. Thus, there are the same problems as described above with regard to thermal heads.

SUMMARY OF THE INVENTION

The present invention overcomes the drawbacks of the prior art. The present invention pertains to a heat recording method in which electric current is passed through a heat generating resistor, such as a thermal head or a heat generating resistance layer of a conduction recording paper. In order to simplify description, both recording types are referred to as a heat generating resistor. The electric current causes the heat generating resistor to generate Joule heat, and by the temperature elevation of the heat resistor due to this heat generation, the recording on a recording medium is carried out. In the methods of recording known as heat sensitive recording, heat transcription recording, thermal ink jet recording, conduction heat sensitive recording, conduction transcription recording, etc., the above-described heat generating resistor has a specified boundary temperature region with almost step-like resistance changing characteristics.

These resistance changing characteristics change to a lower resistance value at a lower temperature than the boundary temperature region and to a higher resistance value at a higher temperature that the boundary temperature region. When the temperature of the heat generating resistor is less than the specified boundary temperature region and one voltage pulse is applied to the heat generating resistor, a steep temperature rise occurs with a large electrical power consumption. After the temperature has reached the specified boundary temperature region, one voltage pulse produces a mild temperature rise with smaller electric power consumption until completion of the voltage application. When the heat generating resistor is at a higher temperature than the specified boundary temperature region at the start of the voltage application, such as when the mild temperature rise state is maintained during the application of voltage pulses, the speed of the temperature rise of the heat generating resistor changes in correspondence to the temperature before the voltage pulse is applied. Heat temperature control is effected such that the temperature rise peak temperature of the heat generating resistor generated from a constant pulse width approaches a constant temperature. By dividing a plural number of heat generating resistors into blocks, the heat generating temperature control can be effected by appling current pulses in a time-sharing manner to heat generating resistors of the respective blocks.

In the first current consumption state, corresponding to the steep temperature rise during which time the current consumed by the heat generating resistor during the time the voltage is applied is large, and a second current consumption state corresponding to the mild temperature rise state when a smaller current is consumed, a reduction in the driving peak current is desirable. In order to reduce the driving peak current, the plural number of blocks of heat generating resistors are applied with current pulses in a time-sharing manner such that the first current consumption state of a first block does not overlap with the first current consumption state of another arbitrary block, and also in a time-sharing manner such that the second current consumption state of a first block of heat generating resistors and the first current consumption state of another block of heat generating resistors is delayed so as to drive the plural number of blocks in a time-sharing manner, thus producing excellent characteristics such as a reduction of the driving peak current or the like in a heat recording device.

It is an object of the present invention to solve the various problems associated with making the temperature of heat generating resistors uniform.

It is another object of the present invention to overcome the complication of temperature control of the heat generating resistors as compared with the conventional art, by allowing self-temperature control of each heat generating resistor to prevent a temperature rise of more than a specified temperature.

Also, it is an object of the present invention to obtain excellent thermal characteristics of heat generating resistors with a lower peak current.

In accordance with the present invention, the heat generating resistors have a characteristic temperature change which is almost step-like. This is accomplished by providing a specified temperature region by controlling and applying voltage such that when the temperature of the heat generating region is less than the boundary region, a voltage pulse is applied to the heat generating resistor until the above specified boundary region is obtained. The steep temperature rise described above of the heat generating resistor is obtained in a short time with relatively a large electrical power consumption, until reaching the specified boundary temperature region by applying one voltage pulse. Thus a mild temperature rise of the heat generating resistor, which requires smaller electrical power consumption to effect recording, is used. Furthermore, when the heat generating resistor is at a higher temperature than the specified boundary region, the mild temperature rise state is maintained to carry out recording. Also, a plurality of heat generating resistors are divided into a plural number of blocks and are driven in a time-sharing manner such that in relation to at least the two states of the first current consumption state and the second current consumption state (the steep temperature rise and the mild temperature rise), the blocks are driven so that two blocks do not overlap in the first current consumption state, and also in a time-sharing manner such that the second current consumption state of one block is delayed from the first current consumption of another block.

When the heat generating resistor is at a higher temperature than the specified boundary temperature region, the heat generating resistor is assumed to be the first heater. Then, when it is at a lower temperature than the specified boundary temperature region, it becomes parallely combined with a second heater in a circuit comprising the heat generating resistor. Thus, when a constant voltage is applied and when the temperature of the heat generating resistor is lower than the specified boundary temperature region, current flows to the first heater and the second heater at the same time and the consumption current in the heat generating resistor rises steeply. When the temperature reaches the specified temperature boundary region, or is at a high temperature, the second heater stops being electrically conductive due to a rise of its resistance value, or becomes minutely electrically conductive. In other words, the second heater plays the role of an auxiliary heater until the temperature of the heat generating resistor rises above the specified boundary temperature region. Also, the consumption current in the heat generating resistor changes from the state of a large current to the state of a low current in accordance with the specified temperature boundary region.

Therefore, the heat generating resistor itself has the function of controlling its own heat generating characteristics by changing the heat generating time of the auxiliary heater in correspondence to the temperature of the heat generating resistor directly before voltage pulses are applied. As a result, recording at a more uniform temperature can be realized.

Furthermore, when electrical conduction begins in respective heat generating resistors simultaneously, such as when a plurality of heat generating resistors are driven, the total current applied in the time until the temperature of the heat generating resistors reaches the specified temperature boundary region becomes an extremely large value. However, when the plural number of heat generating resistors are divided into a plural number of blocks, the peak current decreases in correspondence to the number of this division. Further, when the first current consumption state of the respective blocks does not overlap, and the second electric current consumption state of one block may overlap with the first and second current consumption states of other blocks, although the total effective current increases, the total current value at any arbitrary time does not have a step-like large variation, and the fluctuation of the output of electric source current becomes negligible. Also, since the electric conduction time of the respective blocks is partially overlapped, the time before all of the blocks are finished being applied with electrical conduction is slight.

In summary, the present invention improves the resistance value characteristics of a heating resistor used in a thermal recording apparatus. The heating resistor has a characteristic in that the resistance value changes almost in a stepwise manner while a predetermined temperature range forms a boundary. In other words, the heating resistor has a relatively low resistance value in a temperature region lower than the predetermined temperature range, and it has, in a higher temperature region, a resistance value which is higher than the low resistance value of the lower temperature region. In accordance with the present invention, one pulse of a constant voltage is applied to the heating resistor. Thus, a large amount of heat is generated, and the temperature of the heating resistor rises steeply in a range from a point before applying the pulse to a point when the temperature reaches the predetermined temperature range. Then, after the temperature reaches the predetermined temperature range, a small amount of heat is generated, and the temperature rises gently until the pulse application ends. Thus, in accordance with the present invention the maximum temperature of the heating resistor can be controlled during the pulse application and high quality printing can be easily realized.

Furthermore, in accordance with the present invention, a method of driving a heating resistor is provided which enables efficient use of the power supply of the thermal recording apparatus which has many heating resistors having such resistance characteristics as described above. When the heating resistor is provided with a resistance value which may be changed, the current which is generated in the heating resistor by means of application of a constant voltage pulse changes from a first state with a large current to a second state with a small current in a stepwise manner while the pulse is being applied, In accordance with the present invention, a number of heating resistors used in one thermal recording apparatus are divided into a plurality of blocks. The respective blocks of the heating resistors are sequentially applied with pulses to generate heat. Then, each of the plurality of blocks is driven sequentially so that the first state with a large current within the pulse application time of one block does not coincide with the first state of another block. This driving method enables controlling the amount of current flowing through each of the blocks. Furthermore, restraining the current from increasing in high speed printing can be simultaneously realized by driving sequentially a plurality of blocks so that the second state with a small current within the pulse application time of one block does not coincide with the first state with the large current within the pulse application time of another block which is applied with a pulse next.

DETAILED DESCRIPTION OF THE INVENTION

Figure 1:
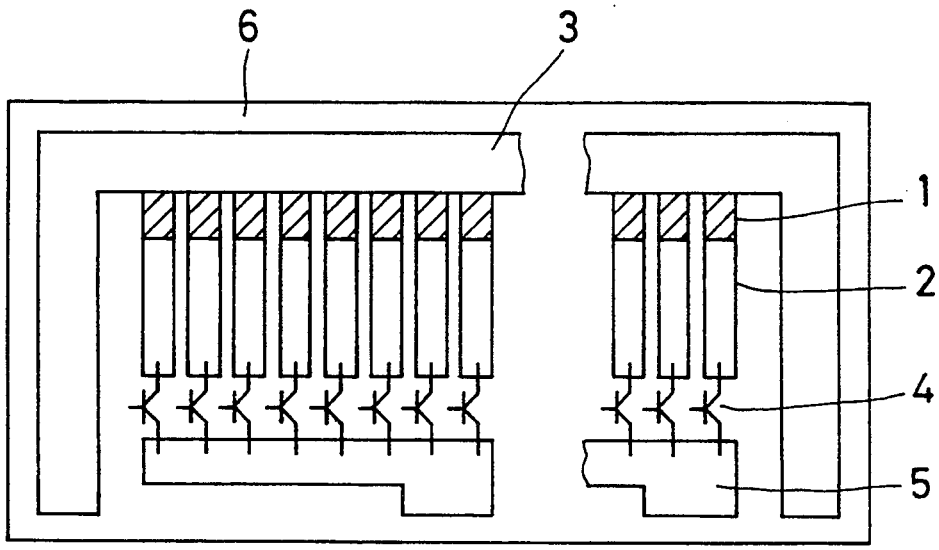
FIG. 1 is a plan view of a thermal head in a first embodiment of the present invention.
Figure 2:
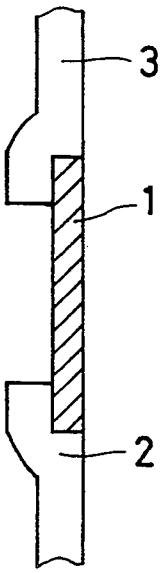
FIG. 2 is a sectional diagram of the heat generating resistor of the thermal head of FIG. 1.

FIG. 1 is a plan diagram of the thermal head used in heat sensitive recording and the like relating to the driving method of the present invention. FIG. 2 is a sectional view of the heat generating resistor part of the thermal head. On a substrate 6 of a glazing-treated alumina ceramic or the like, a heat generating resistor 1 is provided. The heat generating resistor 1 is comprised of a thin film consisting of a material having characteristics of metallic electrical conductivity in the low temperature side, up to about 150° C., and of semiconductor-like electrical conductivity in the high temperature side. One terminal of the heat generating resistor is connected to an individual electrode 2 and another terminal is connected to a first common electrode 3. The individual electrode 2 is connected to a switching element 4 comprised of a transistor or the like. Reference numeral 5 denotes a second common electrode connected to the switching element 4. For a thermal head, it does not matter whether or not the above-described switching element 4 and the second common electrode 5 are provided; they are provided separately as part of a recording device.

By opening and closing the switching element 4 while applying positive potential to the first common electrode 3 and negative potential to the second common electrode 5, voltage pulses are applied to the heat generating resistor 1. When such voltage pulses are applied to the heat generating resistor 1, electric power consumption suitable to generate Joule heat due to the voltage applied across the heat generating resistor 1 occurs, and the temperature of the heat generating resistor 1 begins to rise. When the heat generating resistor is in the low temperature phase of the above-described metal/semiconductor phase transition, that is, in the metal phase, the resistance value is lower, and the heat generating resistor consumes a large amount of electrical power, resulting in a sharp temperature rise.

Figure 10:
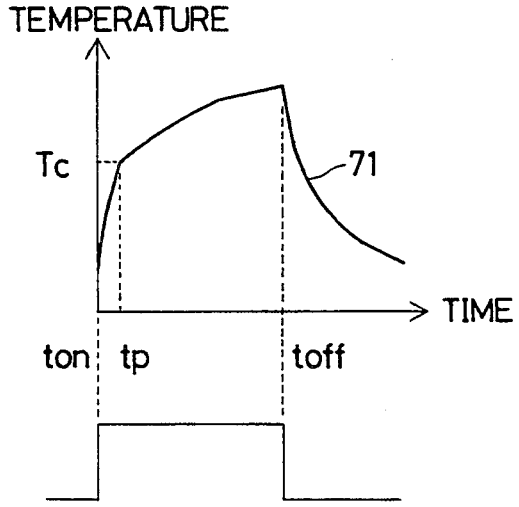
FIGS. 10, 11 and 12 are diagrams representing the surface temperature change of the heat generating resistors according to the present invention.

FIG. 10 is a diagram representing the time change of the surface temperature 71 of the heat generating resistor 1 this figure, $T_c$ represents the temperature of the accompanying the above-described voltage pulse application. In this figure, $T_c$ represents the temperature of the metal/semiconductor phase transition in the electrical conductivity characteristics of the heat generating resistor; $t_{on}$ represents the application start time of the above-described voltage pulse; $t_p$ represents the time for the heat generating resistor surface temperature to reach the phase transition temperature $T_c$; and $t_{off}$ represents the application finish time of the above-described voltage pulse. In the interval from $t_p$ to $t_{off}$, the heat generating resistor 1 has a higher resistance value because of the metal to semiconductor phase transition, and the surface temperature of the heat generating resistor 1 gradually rises in the vicinity of the phase transition temperature $T_c$. The actual heat generating resistor temperature can be slightly higher than the above-described $T_c$ due to thermal inertia from the heat capacity and heat resistance of the heat generating resistor itself and the surrounding structural members. The surface temperature rise of the heat generating resistor takes place from $t_{on}$ to $t_p$. When the area of the heat generating resistor 1 is 0.015 mm$^2$, which corresponds to the heat generating resistor density of 8 dot/mm, the resistance value in the low temperature side of the heat generating resistor is about 500Ω, the resistance value in the high temperature side about 2000Ω, and the applied voltage 20 V. When a heat-absorbing material such as a heat sensitive paper, etc. is not contacted to the surface of the heat generating resistor 1, the temperature reaches $T_c$, approximately 150° C., which is the base temperature of the above-described heat generating resistor 1, from a temperature $t_{on}$ of room temperature. The time from $t_{on}$ to $t_p$ is less than about 0.2 millisec. The heat generating resistor 1 reaches the temperature sufficient for heat sensitive recording, approximately 300+degrees C., in about 1 millisec. Since the heat resistance of the heat generating resistor and the thermal characteristic of heat capacity changes with the glaze thickness of the above-described glazed substrate of the thermal head (the thickness of the protection layer coated on the surface of the heat generating resistor), this time becomes different depending on the structure of the thermal head. However, the above-described phase transition temperature $T_c$ is a characteristic of the material of the thermal head. However, the above-described phase constituting the heating resistor, and is not dependent on the thermal characteristics or structure of the thermal head as described above. Thus, the temperature of the heat generating resistor can rise to the level of $T_c$ in an extremely short time depending on the material comprising the heating resistor.

As has been explained with regard to the conventional art, in the thermal head there exists fluctuation of thermal characteristics such as the heat dispersing characteristics and the like for the heat generating resistor. Although this fluctuation appears in the time constant of the temperature rise and cooling above $T_c$, that is, after $t_p$, and the fluctuation of the temperature rise gradient from the above-described $t_{on}$ to $t_p$, that is, a small fluctuation in the time of $t_p$, there is no case where the value of $T_c$ fluctuates. However, the color generating mechanism utilized in heat recording is a chemical reaction using the heat of a heat generating agent in a direct heat sensitive system. The reaction speed depends on temperature. In the heat transcription system and the thermal ink jet system, the reaction speed depends on a physical phase change such as the physical melting, sublimation, and evaporation of the ink, and recording is governed by the temperature of the ink. Therefore, in the present invention, in which recording is controlled at the middle point of the temperature rise by the constant temperature $T_c$, in comparison with the case where the temperature cannot be directly controlled such as in the conventional art, the effect of the fluctuation of the thermal characteristics of the thermal head to the recording characteristics becomes extremely small.

In addition, the fluctuation of the resistance value can be caused by the resistance film thickness, etc. This fluctuation results in the fluctuation of the time from $t_{on}$ to $T_c$ and in the temperature rise gradient from $t_p$ to $t_{off}$. However, $T_c$ is a characteristic of the substance and has no relationship to the resistance value itself, and in the same manner as in the case of the above-described thermal characteristics fluctuation, the effect of the resistance value fluctuation to the recording characteristics is nominal.

When it is desired that the temperature rise gradient due to the fluctuation of the resistance value of the above-described heat generating resistor and the peak temperature fluctuation at the time $t_{off}$ be made smaller and more uniform, the applied voltage or current may be adjusted in such a manner that they become uniform depending on the size of the heat generating resistor resistance value in the phase of the semiconductor electrical conductivity in the high temperature side of the heat generating resistor. Alternatively, to make the temperature rise gradient uniform, the electric power from $t_p$ to $t_{off}$ (in reality, from $t_{on}$ to $t_{off}$) may be adjusted.

Further, when more extreme uniformity is required, the applied voltage may be adjusted depending on the resistance value of the heat generating resistor in the metallic electrical conductivity phase in the low temperature side. In this case, it is intended to make the temperature gradient from $t_{on}$ to $t_p$, that is, to the above-described $T_c$, uniform, and the time itself from $t_{on}$ to $t_p$ cannot be directly adjusted. Only the voltage adjustment or current adjustment can be carried out.

The time from $t_{on}$ to $t_p$ in the general heat recording device of the present invention is much shorter than the time from $t_{on}$ to $t_{off}$, and since it has been self controlled by the temperature $T_c$, the adjustment effect to the recording characteristics is stronger in the high temperature side between the interval from $t_p$ to $t_{off}$. Therefore, when adjusting the applied voltage or current in such a manner as to become uniform by adjusting the electric power depending on the size of the resistance value of the heat generating resistor in the phase of the semiconductor electrical conductivity in the high temperature side of the heat generating resistor, the effect of the adjustment from $t_{on}$ to $t_p$ may be neglected. On the other hand, when adjustment of the applied voltage and current depending on the size of the resistance value of the heat generating resistor in the phase of the metallic electrical conductivity in the above-described low temperature side, it is necessary to take into account the effect this adjustment has on the temperature change from $t_p$ to $t_{off}$.

As described above, the effect of the fluctuation of thermal characteristics of the thermal head and the fluctuation of the resistance value to the recording characteristics is extremely small in accordance with the present invention. In addition, the above-described phase transition temperature, that is, the intermediate control temperature $T_c$ shown in FIG. 10, is higher and closer to the peak temperature $T_p$ necessary for sufficient recording, so that more uniform recording becomes possible. Furthermore, when the electric power consumption in the high temperature side is less in comparison with the electric power consumption in the side of a lower temperature than $T_c$, or when the constant voltage driving has been considered, the resistance value is higher in the high temperature side than in the lower side, and the difference is larger, so that more uniform recording becomes possible.

In particular, when the conditions for effecting more uniform recording as described above have been satisfied to a high degree, the control of heat sensitive recording can be realized simply and with high precision by controlling the pulse-applying time from $t_{on}$ to $t_{off}$.

Although the temperature of the metal semiconductor transition of the above-described heat generating resistor has been set at about 150° C. in the above-described embodiment, in a high speed heat recording device requiring higher peak temperature, a vehicle mounted heat recording device using high temperature color generating heat sensitive paper, and a thermal ink jet for recording short pulses, the heat generating resistor can have a high phase transition temperature such as 200° C., 250° C., etc. When the resistance value of a heat generating resistor is made low (or the applied voltage is high) to make the electric power large, the color generation reaction of the heat sensitive paper occurs in a sufficiently short time because of the high temperature, and even a short applied pulse width ($t_{off}$-$t_{on}$) from $t_p$ to $t_{off}$ can obtain a consistent peak temperature so that uniform recording becomes possible. On the other hand, in the thermal head and the like of a low speed low electric power consumption type, the resistance value of the low temperature side and the resistance value in the high temperature side may be made higher (or the applied voltage may be made low), to let the temperature rise occur gradually to $T_c$, and further to let it gradually reach the peak temperature. In this case, since the peak temperature does not have to be too high, the above-described phase transition temperature $T_c$ may be lowered to 120° C., or so.

Figure 3:
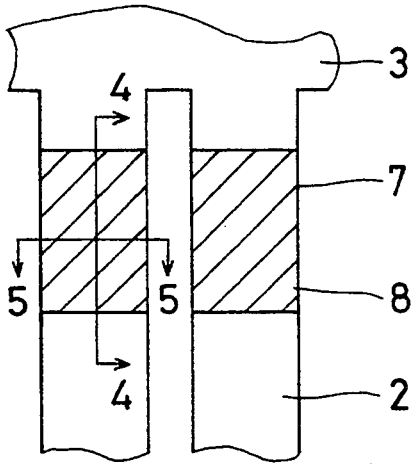
FIG. 3 is a plan view of the heat generating resistor in a second embodiment of the present invention.
Figure 4:
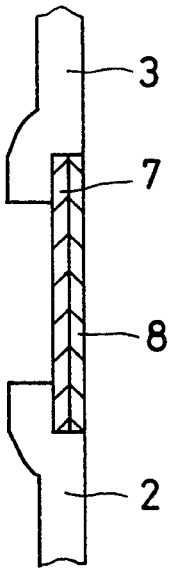
FIGS 4 and 5 are sectional diagrams along lines 4—4 and 5—5 of the heat generating resistor in FIG. 3.
Figure 5:
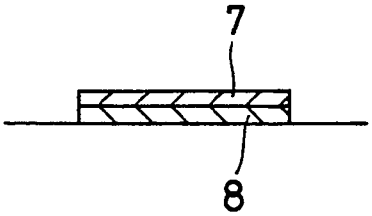
Figure 11:
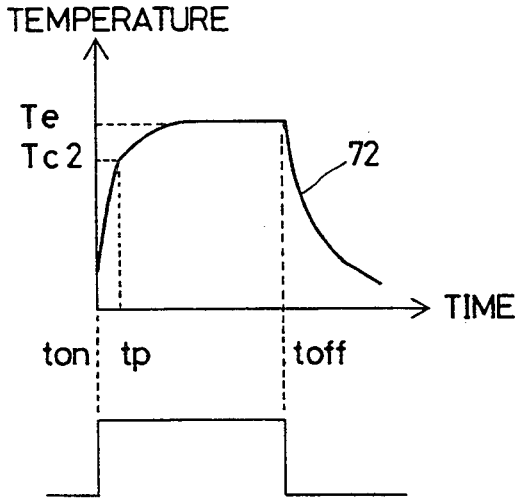

FIG. 3 is a diagram explaining a second embodiment of the present invention, and shows a plan view of the essential part of a thermal head equipped with a heat generating resistor connected between the individual electrode 2 and the common electrode 3. The first resistor 7 comprises ordinary heat generating resistor materials such a tantalum nitride, thermet, etc., and the first resistor 7 and the second resistor 8 consisting of a film pattern for effecting the metal/nonmetal (insulator) phase transition are formed into a laminated layer. FIG. 4 is a sectional diagram along the line A–A′ of this heat generating resistor, and FIG. 5 is a sectional diagram along the line B–B′. When voltage is applied to the above-described individual electrode 2 and the common electrode 3, and when the temperature at that time is lower than the phase transition temperature $T_{c2}$ of the second resistor 8 as shown in FIG. 11, the heat generation for recording is generated in the first resistor 7 and the second resistor 8. When the temperature of the heat generating resistor (that is, the temperature of the second resistor) reaches $T_{c2}$, the second resistor is changed to a non-metal (or changed to an insulator), and emits almost negligible heat as compared with the heat generation of the first resistor. Therefore, in this state, only slight heat generation is found in comparison with the heat generating state in a temperature lower than $T_{c2}$, and the temperature rise on the surface of the heat generating resistor changes in the same manner as that in the figure representing the temperature change of FIG. 10. The surface temperature rise of the heat generating resistor takes the time from $t_{on}$ to $t_p$. When the area of the heat generating resistor 7,8 is taken to be 0.015 $mm^2$, which corresponds to the heat generating resistor density of 8 dot/mm, the resistance value of the first resistor is 2200Ω, the resistance value in the lower temperature side than $T_c$ of the second resistor is approximately 650Ω, and the resistance value in the high temperature side as 2000Ω. The parallel resistance value below the temperature $T_{c2}$ is about 500Ω, and above $T_{c2}$ is about 2000Ω, and the resistance value characteristics equal to the case of the above-described first embodiment are obtained. Therefore, the heat generating characteristics are also approximately equal. Although in the above-described resistance value example, the second resistor has effected the resistance change of about 30 times by making $T_{c2}$ as the boundary, by the selection of the resistance material, changes more than 2 orders are also possible. In the second embodiment, parallel resistance is used, and therefore the freedom of material selection for realizing the necessary resistance value is high.

In a third embodiment of the present invention, when the resistance value is designed such that the electric power consumption per area becomes low to a certain extent in the temperature above $T_{c2}$, by utilizing the structure of the above-described second embodiment having high freedom of material selection, then, as shown in FIG. 11 in the changing curve 72 of the heat generating resistor surface temperature, even if stationary electric power consumption has been carried out by applying DC voltage, the heat generating resistor surface temperature reaches the equilibrium temperature $T_e$ where the heat generation and the heat dissipation becomes equal to that in a temperature range where the heat generating resistor is not burned out, and the equilibrium temperature $T_e$ can be maintained for as long as the voltage is applied. It is possible to maintain an equilibrium temperature using a sole ordinary resistor such as first resistor 7. In accordance with the present invention, the temperature control such as the bias temperature is carried out at $T_{c2}$, which is slightly lower than equilibrium temperature $T_e$. The equilibrium temperature $T_e$ is not affected by ambient temperature conditions and since the temperature rise to $T_{c2}$ is helped by the heat generation of the second resistor 8, the equilibrium temperature $T_e$ is reached in a shorter time and with slight time fluctuation. When the equilibrium temperature $T_e$ stabilized in such a manner as described above is realized, the reproducibility of harmonious recording control by the timing control of $t_{off}$ can be enhanced, and excellent printing quality can be provided.

Figure 12:
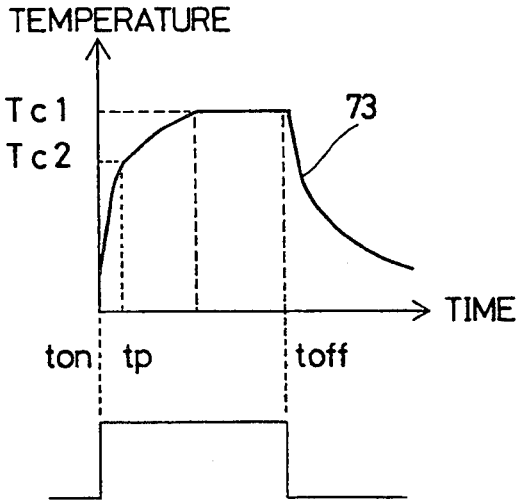

In a fourth embodiment of the present invention, it is possible to constitute the above-described first resistor 7 in the second embodiment with a material for effecting the transition of metal/nonmetal (insulator/semiconductor) at $T_{c1}$, which is different to the phase transition temperature $T_{c2}$ of the above-described first resistor 7 as shown in FIG. 12.

In accordance with this embodiment, when the phase transition temperature $T_{c1}$ of the first resistor is taken as 200° C., and the phase transition temperature of the second resistor is 150° C., a constant voltage applied to a heat generating resistor has a surface temperature behavior as shown in the change curve 73 of the heat generating resistor surface temperature of FIG. 12. A sharp temperature rise occurs from $t_{on}$ for starting voltage application to the temperature $T_{c2}$, and then from $T_{cc}$ to $T_{c1}$ a mild temperature rise occurs. The subsequent temperature rise becomes milder or stabilized to a temperature rising above $T_{c1}$.

The conditions for effecting a stable temperature rise not above $T_{c1}$ are such that the parallel resistance value of the first and second resistors in the temperature above $T_{c1}$ is high, and heat generation is insufficient to cause the temperature to rise above $T_{c1}$. In addition, a continuous voltage is applied to the second resistor at a temperature in the vicinity of $T_{c1}$, to realize the state in which the phase transition from the metal phase to the non-metal phase and from non-metal phase to metal phase continuously occurs. When such a state is realized, harmonious recording can be easily carried out in the same manner as in the case of realizing the above-described equilibrium temperature $T_c$, and since the region of high temperature, that is, from $T_{c2}$ to $T_{c1}$, is made to have a mild temperature gradient, the heat shock surrounding the heat generating resistor in the high temperature part is lessened, and therefore, the heat generating resistor has a heat generating structure having high reliability.

Figure 13:
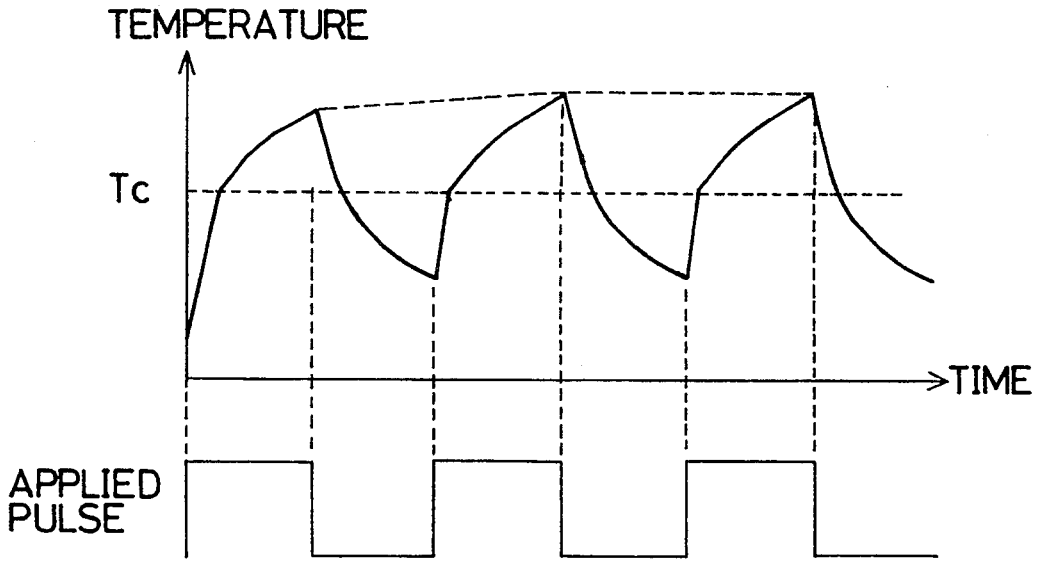
FIGS. 13 and 14 are diagrams representing the change in the continuous heat generating resistor according to the present invention.
Figure 14:
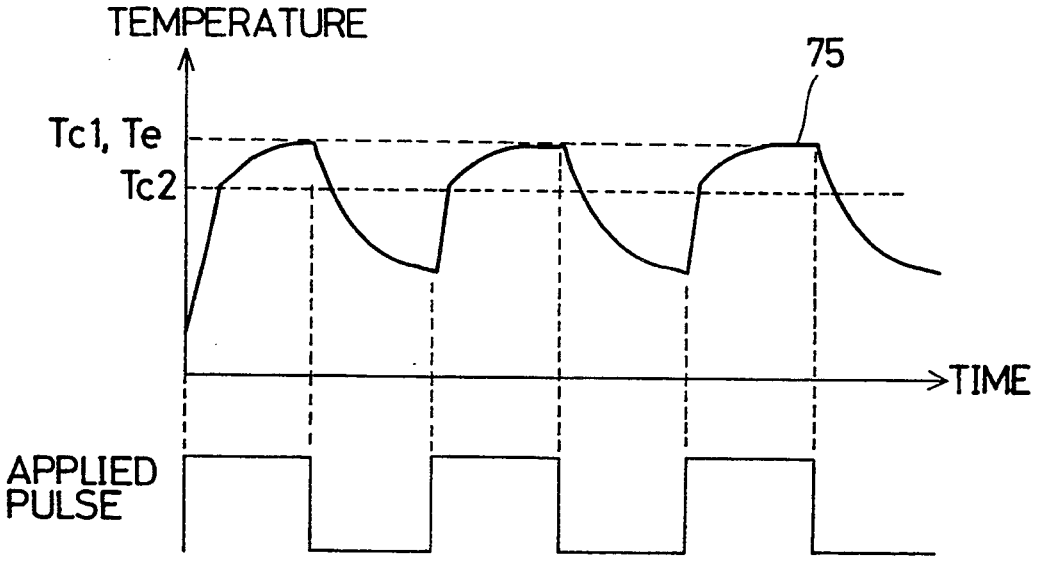

The manner of the temperature change of the heat generating resistor surface when the heat generating resistor structures of the first and second embodiments shown in FIGS. 1 and 3 have been driven with continuous pulses such as is shown in FIG. 13, and also, the manner of the temperature change of the heat generating resistor surface when the heat generating resistor structures of the third and fourth embodiments have been driven with continuous pulses, are shown in FIG. 14. The intermediate temperature $T_c$ rising up in steep gradient and reached from the first pulse to the nth pulse is constant. Although the temperature rise time by the first pulse becomes a little longer such that the initial background temperature of the heat generating resistor is low, after the second pulse, the heat generation curve becomes almost level. In such a manner as described above, even without carrying out specific control of driving the resistor, self control resulting in a constant heat generation temperature can be obtained. Although the heat generating temperature rise time is long, it does not become a problem. However, when strict recording concentration is required, the peak temperature preserving time may be uniformly controlled by elongating the applied pulse width for such a grade that the temperature rise is long only during the first pulse, that is, when the background temperature is low.

In the recording device for carrying out consistent recording, consistent control is carried out by controlling the length of the applied pulse width irrespective of the device, such as the direct heat sensitive system, sublimation transcription system, and electric conduction recording being controlled. In the conventional heat recording method, since the peak temperature of the heat generating resistor is changed greatly together with the length of the pulse width, consistent control has been difficult. In accordance with the present invention, since at least the intermediate temperature of the heat generation and temperature rise procedure is self-controlled to a constant value, it is possible to carry out consistent control in which the heat generation peak temperature and the total energy given to the ink and the like are controlled with good reproducibility. In particular, the third and fourth embodiments produce the state in which the peak temperature is uniform, and strict consistent recording can be realized. Although in the conventional art the relative concentration control of about 64 elements is carried out, in the absolute control, at most, control of 16 elements is possible. However, in the thermal head in accordance with the present invention, as is evident by the above explanation, absolute concentration control is easy, and control of 128 elements and 256 elements are also possible.

Figure 15:
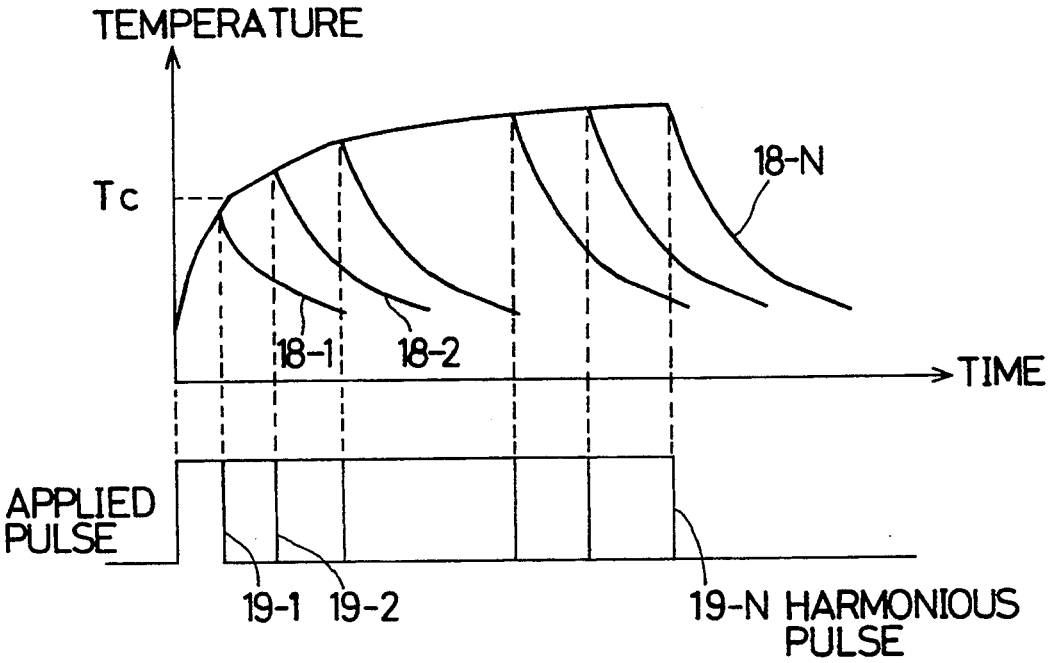
FIGS. 15 and 16 are diagrams representing the temperature change in the harmonious control of the surface temperature of the heat generating resistor according to the present invention.
Figure 16:
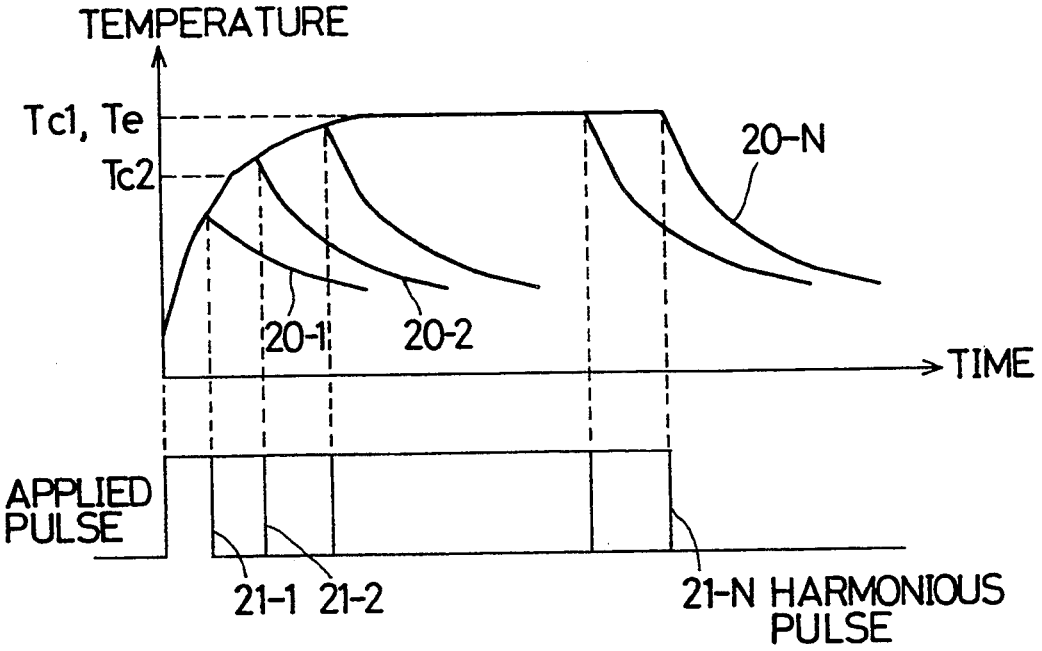

FIG. 15 is a diagram representing the temperature waveform of the heat generating resistor surface temperature versus the applied pulse width to the heat generating resistor in the heat recording method of the first and second embodiments of the present invention in harmonious control. FIG. 16 is a diagram representing the temperature waveform of similar heat generating resistor surface temperature of the third and fourth embodiments. In the respective figures, the heat generating resistor temperature waveforms 18-1, 20-1 by the first pulses 19-1, 21-1 result in a cooling depression in the middle of the temperature rise procedure. Even in the pulse setting such as described above, when almost all of the pulses to the nth pulse are applied after the time for reaching the self controlled intermediate temperature $T_c$ or $T_{c2}$, high precision is obtained.

Figure 6:
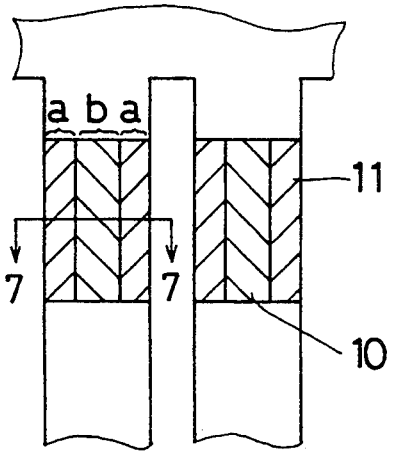
FIG. 6 is a plan view of the heat generating resistor in another embodiment of the present invention.
Figure 7:
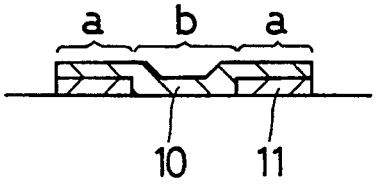
FIG. 7 is a sectional diagram along line 7—7 of the heat generating resistor of FIG. 6.

A fifth embodiment of the present invention will now be described. In the above-described second embodiment shown in FIGS. 3, 4, and 5, although the plane shapes of first resistor 7 and the second resistor 8 are the same, it is possible for the first resistor 10 and the second resistor 11 to be parallel as shown in FIG. 6. FIG. 7 is a C-C′ sectional diagram of the heat generating resistor in FIG. 6. The shape of this first resistor 10 agrees with the external shape of the heat generating resistor, and the second resistor 11 is formed at a part a in slit b opened in the central part of the heat generating resistor. On the second resistor 11 is laminated the first resistor 10.

Figure 18:
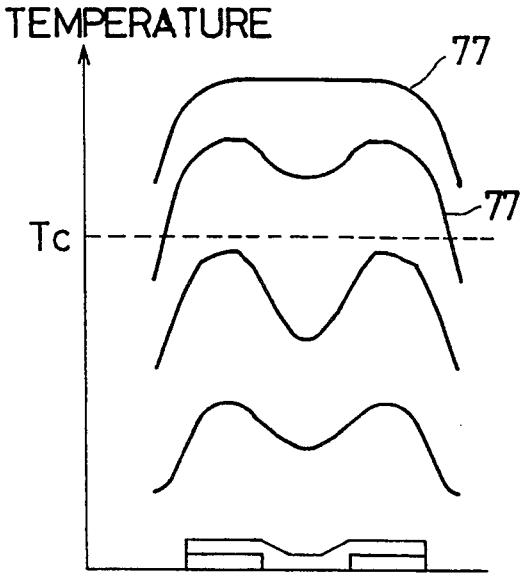

When the voltage pulses are applied to the heat generating resistor of this fifth embodiment to generate heat, the change in the temperature rise procedure of the heat generating resistor surface temperature distribution of the C-C' sectional surface of FIG. 6 takes the form of the distribution curve 77 of the heat generating resistor surface temperature distribution of FIG. 18. The area where the first resistor and the second resistor are laminated carries out a prompt temperature rise until it reaches the temperature $T_c$, and the region depicted as b in FIG. 7 becomes the valley of the temperature. When the a region exceeds the temperature $T_c$, in the total region a and b, there is heat generation by the first resistor only, and mild heat generation is carried out uniformly. In the state above $T_c$, the heat in the a region diffuses into the b region which has formed the valley of the above-described temperature curve, and the surface temperature distribution of the heat generating resistor sectional surface approaches a trapezoid shape. Thus, in contrast to the temperature distribution of the conventional heat generating resistor which has a temperature peak at its central part, the resistor of the present invention has a uniform heat generation distribution along the whole surface of the heat generating resistor.

Figure 8:
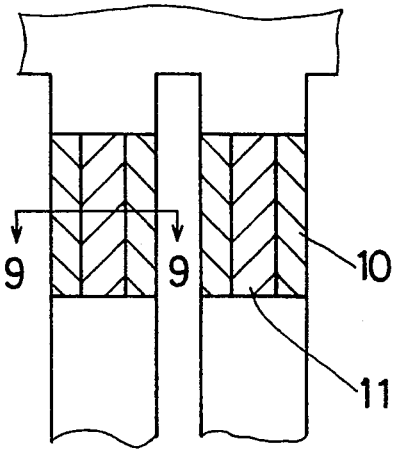
FIG. 8 is a plan view of the heat generating resistor in another embodiment of the present invention.
Figure 9:
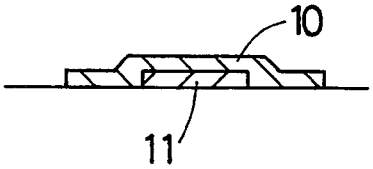
FIG. 9 is a sectional diagram along line 9—9 of the heat generating resistor of FIG. 8.
Figure 17:
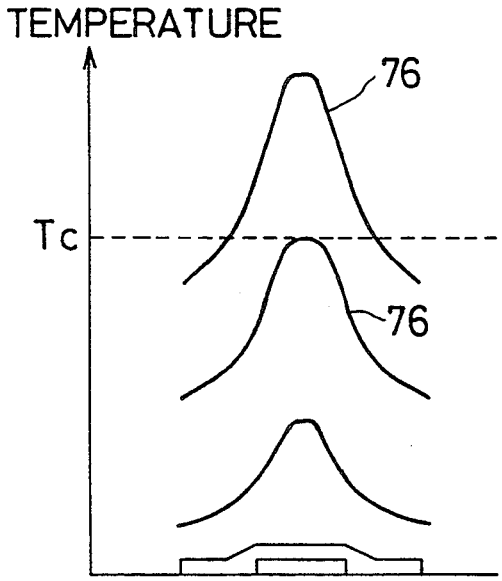
FIGS. 17 and 18 are diagrams representing the distribution of surface temperature of the heat generating resistor according to the present invention.

In a sixth embodiment of the present invention, as shown in the plan diagram of the heat generating resistor in FIG. 8, and the D-D' sectional diagram of this heat generating resistor in FIG. 9, when the second resistor 11 in FIGS. 6 and 7 is provided in the b region and is not provided in the a region, the distribution curve 76 of the heat generating resistor surface temperature shown in FIG. 17 occurs. The temperature peak of the b region, that is, the central part of the heat generating resistor becomes sharper than that of the conventional art, and since the temperature is higher, $T_c$ has more tendency to approach the conventional sharpness, so that the utilization of this embodiment in the net point system harmonious method by the applied energy adjustment in the heat sensitive recording brings about the improvement of the reproducibility of the harmonious region of low concentration (small area), which has been difficult to obtain heretofore.. Also, it is adaptable to the generation of air bubbles in a liquid ink which requires spontaneous high temperature, such as in the thermal ink jet.

The above description relates to the embodiments for uniform control of the heat generation temperature of the heat generating resistor for applying heat to the recording medium such as heat sensitive paper, or the ink donor sheet for being transcripted to a recording medium, or a liquid ink. In a seventh embodiment, the current passing heat recording method, in which voltage pulses are applied by a current passing head which has a current passing electrode in electrical contact with the heat sensitive paper within a heat generating layer and the ink donor sheet, the heat sensitive paper and the ink donor sheet themselves generate heat for recording by use of a laminated heat generating layer having a first resistance layer comprising an ordinary heat generating resistance material such as a carbon paint as the heat generating layer, and a second resistance layer comprising materials for effecting the phase transition of metal/non-metal, for example, at a temperature $T_{c5}$. Uniformity of the recording can be obtained by uniform self control of the heat generation intermediate temperature. The following explanation will be given of the embodiment of the present invention in accordance with this current passing heat recording.

Figure 19:
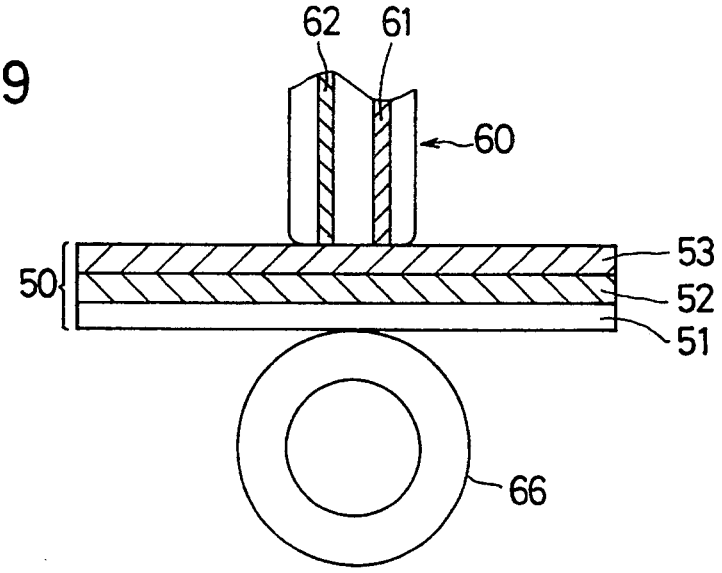
FIG. 19 is an essential part sectional diagram of the current passing heat sensitive recording device in another embodiment of the present invention.

FIG. 19 is a sectional diagram of a current passing heat sensitive recording device. The current passing heat sensitive recording paper 50 comprises a color generating recording layer 51, the above-described second phase transition resistance layer 52, and the above-described first ordinary resistance layer 53. The second resistor layer 52 is a layer formed by uniformly painting or vapor evaporating a material comprising a main component made with an elementary material, in which electrical conductivity changes to metallic in the low temperature side of a specified temperature region, and changes to non-metallic in the high temperature side. The specified temperature region $T_{c6}$ for effecting the change of the above-described electrical conductivity for a recording device such as a high speed recording type, a low consumption electric power type, a harmonious recording type, etc., for example, should preferably range from about 100° C. to 150° C. The current passing heat sensitive recording paper 50 applies voltage pulses between the current passing electrode 61 and the return path electrode 62 in the state in which the above-described current passing heat sensitive recording paper 50 is pinched between the platen 66 and the current passing head 60 to let the above-described first and second resistance layers 53,52 generate heat. When the laminated heat generating layer reaches the heat generating above-described temperature $T_{c5}$, the resistance value in the above-described second resistance layer 52 rises suddenly, almost stopping heat generation, and a mild temperature rise of the color generating layer 51 is brought about by the heat generation of the first resistance layer 53, so that color generation is carried out.

Figure 20:
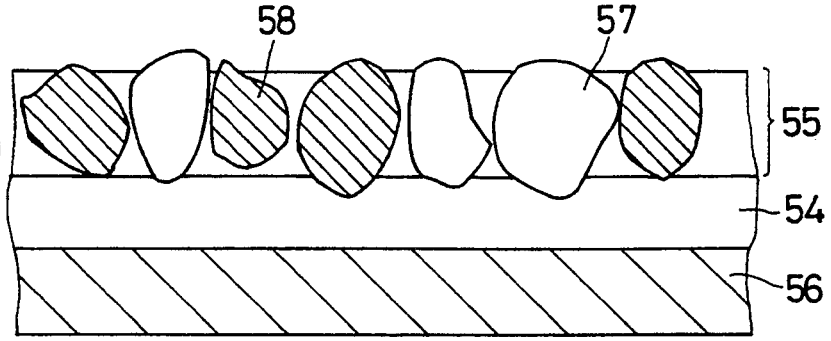
FIG. 20 is a sectional diagram of the current passing transcription using an ink donor sheet in a further embodiment of the present invention.
Figure 21:
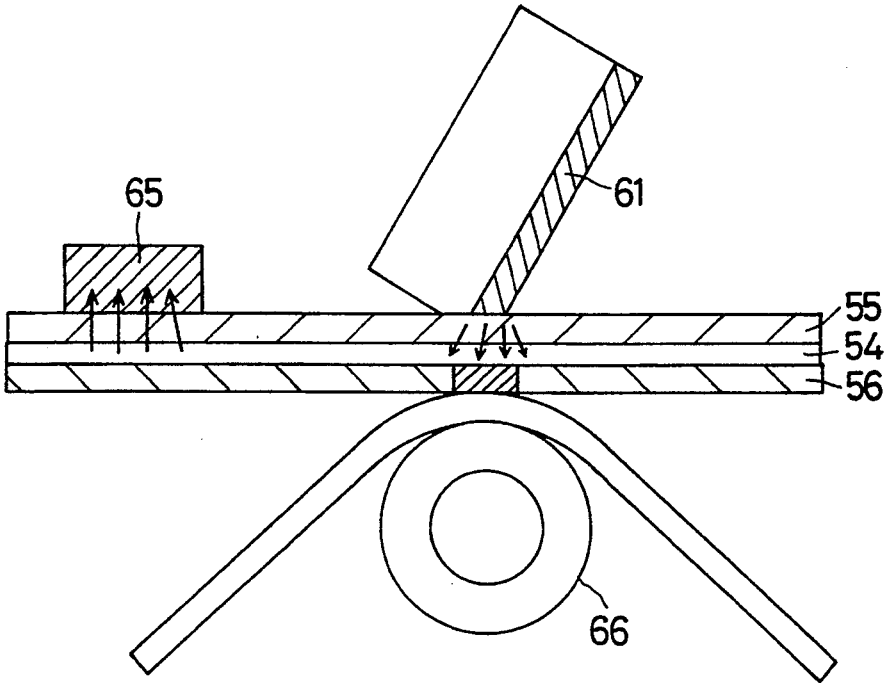
FIG. 21 is an essential part sectional diagram of the FIG. 20 embodiment of the present invention.

In an eighth embodiment according to the present invention, FIG. 20 is a sectional diagram of a current passing transcription using an ink donor sheet provided with a heat melting ink layer 56, an electric conduction layer 54, and a mixed heat generating resistance layer 55 dispersed with second resistance particles 58 comprising a material having elementary materials in which the electrical conductivity carries out metallic change in the low temperature side of the specified temperature $T_{c5}$ and non-metallic change in the high temperature side, as the main component and the first resistance particles 57. FIG. 21 is a sectional diagram of a current passing recording device using this ink donor sheet, and the current between the current passing electrode 61 of the current passing head and the return path electrode 65 provided in a position slightly separated from this current passing head flows mainly in the depth direction of this layer. The second resistance particles 58 for effecting phase transition and the first resistance particles 57 constitute a parallel circuit between the current passing electrode 61 and the electrical conduction layer 54, and both generate heat below the specified temperature $T_{c6}$. The second resistance particles generate little heat above $T_{c6}$.

The above-described mixed heat generating resistance layer 55 and the electric conduction layer 54 may not be provided in the ink donor sheet, and may be provided in a sheet other than the ink donor sheet as a heat generating sheet.

In an embodiment using a material layer (or particles) for effecting metal/non-metal transition and an ordinary resistance layer (or particles) in the heat generating layer of the above-described FIGS. 19 and 21, in the same manner as in the case of the heat recording using the thermal head equipped with the first and second resistors in the above-described second embodiment, the above-described heat generating resistance layer quickly rises to the temperature of the specified temperature ($T_{c5}$ or $T_{c6}$), without depending on the current passing voltage, current passing time, temperature of the current passing head, the temperature before current passing of the current passing heat sensitive paper containing a heat generating resistance layer, the platen, the environmental temperature, etc. Thereafter, a mild temperature rise is carried out. Therefore, the heat generating peak temperature is a stabilized temperature by making the specified temperature ($T_{c5}$ or $T_{c6}$) as the base, and conventional heat control is not required, so uniform heat recording can be realized.

Next, the method of heat generation and driving according to the present invention in all the above described embodiments will be explained by referring to the figures.

Figure 23:
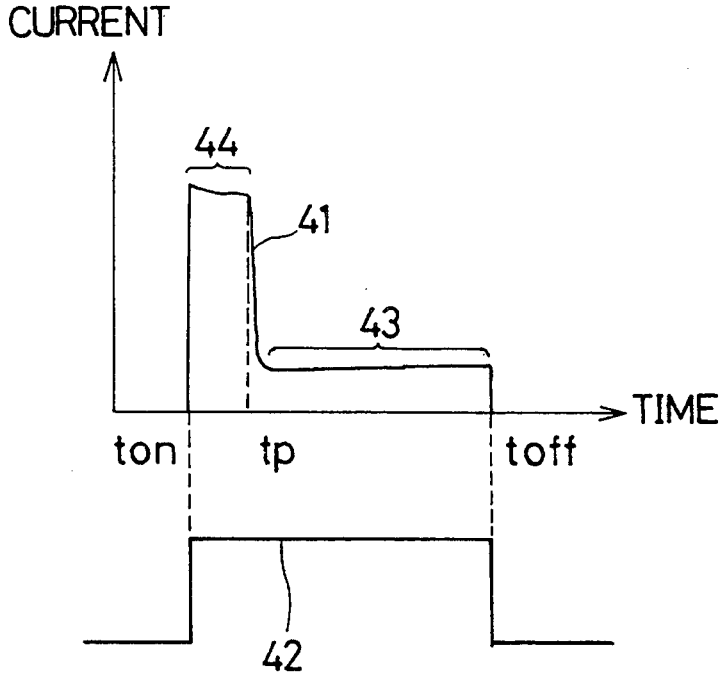
FIG. 23 is a diagram representing the drive current waveform of the heat generating resistor according to the present invention.

FIG. 23 shows the waveform 41 of the current flowing in the heat generating resistor and heat generating resistance layer when voltage pulses 42 are applied to the respective heat generating resistors and heat generating resistance layer. When the heat generating resistor temperature before passing current is below $T_c$ or $T_{c2}$, for example, the resistance value of the second resistor in the above-described second embodiment is low, and the resistance value as a heat generating resistor has become the paralleled resistance value of the first resistor and the resistance value in the second low state, and more current flows through them. This state continues until the time $t_p$, when the second resistor reaches the temperature region of $T_c$, where it shifts to the high temperature phase, and subsequently, the current value lowers to a reduced state to an extent such that the resistance value of the second resistor has been increased. This state is continued until the final current passing pulse. In the case of constant driving voltage, the resistance value of the heat generating resistor becomes about 500Ω before $t_p$, and when it is 2000Ω after $t_p$, the current value decreases by $\frac{1}{4}$ after $t_p$. The resistance value of the first resistor has little temperature dependency, and when it is a general thermal resistor, it has a resistance temperature coefficient of several hundred ppm/°C., and in addition, the resistance value of the second resistor has little temperature dependency even in the temperature region other than the phase transition temperature region where the resistance value changes largely. Thus, little variation of the current value is present even in the pulse application time zone before time $t_p$ and in the pulse application time zone after $t_p$. Also, the above-described current value is subjected to the influence of the inductive and capacitive components of the heat generating resistor circuit. However, the influence of these current values is extremely slight in comparison with the current value change in the vicinity of $t_p$.

Figure 22:
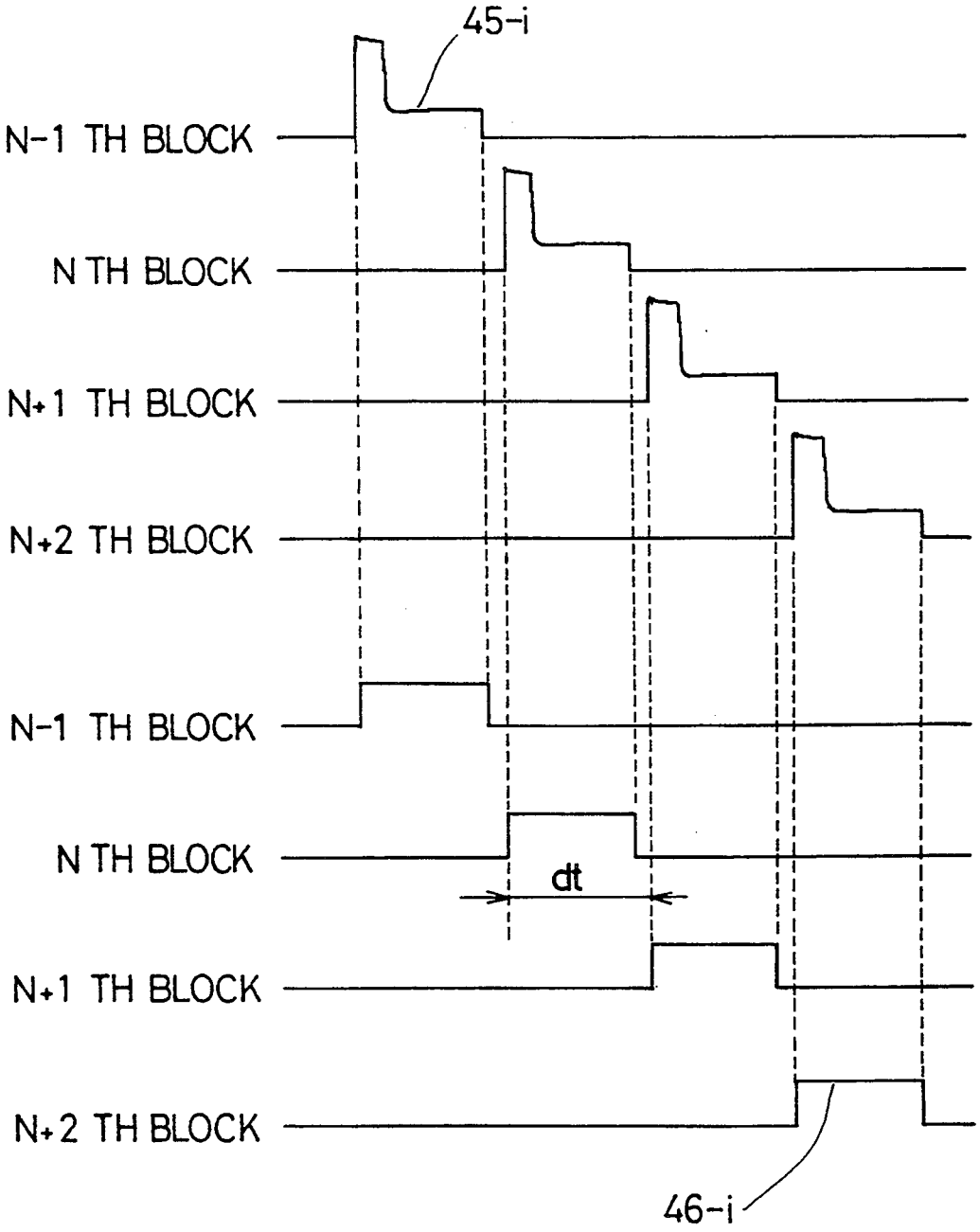
FIGS. 22 and 24 are timing charts representing the drive timing and the current waveform of the heat generating resistor according to the present invention.

Furthermore, in the heat recording devices of respective systems, the recording picture image is displayed with a plurality of dots, and, for example, in the case of a thermal head, many minute heat generating resistors are provided, and respective heat generating resistors form the above-described dots. Since the electric conductive device provided in the above-described recording device cannot be easily made large, the above-described plural number of heat generating resistors are divided into a plural number of blocks, and the time-sharing drive for applying current passing pulses per these blocks is performed. The maximum electric power, that is, the maximum current in the recording, is made small. In the recording device according to the present invention, since a large current change occurs in the current passing pulse of one dot, even if the dividing drive for not overlapping the driving time of the respective blocks such as shown in FIG. 22 is carried out, there is generated a loss in current capacity. However, when the time shift amount of driving of respective blocks such as shown in FIG. 24 is from $t_{on}$ to $t_p$ in FIG. 23, and the number of heat generating resistors in one block is set to be few, the variation of the current, which the above-described electric source supplies, becomes small, and the total current can be reduced.

Figure 24:
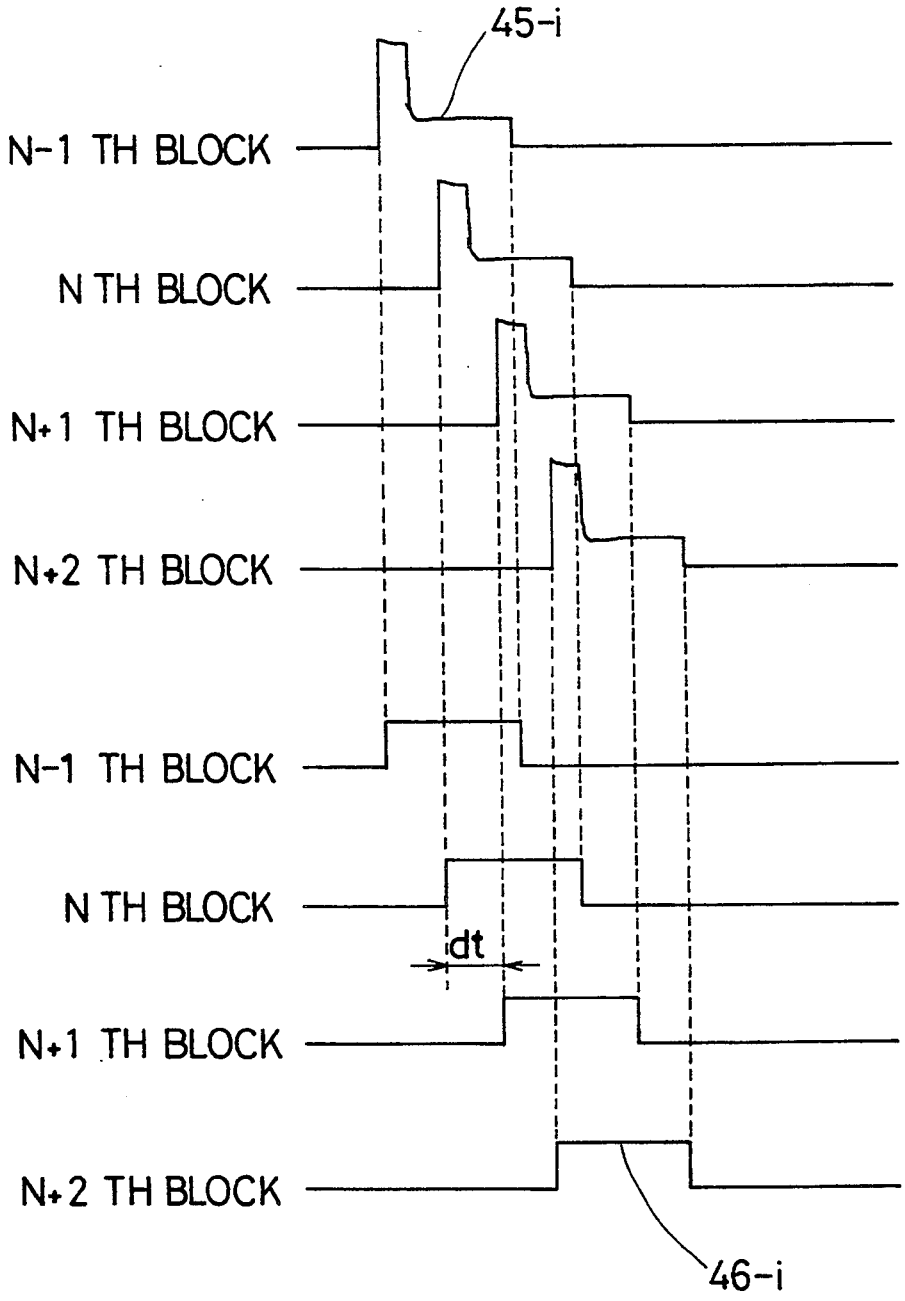

FIG. 24 is an example of the timing chart showing the pulse 46-i applying time in the block division drive, which has the time-sharing and the current wave form 45-i of the corresponding block. The shift time of the division drive is $d_t$. The peak current part (the part corresponding to reference numeral 44 in FIG. 23) of the Nth block overlaps the small current part (the part corresponding to 43 of FIG. 23), and the peak current part of the (N+1)th block also overlaps the small current part of another block. Although it has already been described, the time from $t_{on}$ to $t_p$, which becomes the above-described peak current part, varies little due to the initial temperature of the heat generating resistor, and becomes longer the lower the initial temperature is. This is due to the fact that the heat generating resistor requires more time to raise the temperature to $T_c$ from the lower temperature. For electric source efficiency it is desired that the time from $t_{on}$ to $t_p$ not spontaneously overlap between the respective blocks so that it is better to carry out the division drive of the block in the timing having set $d_t$ a little longer than the time from $t_{on}$ to $t_p$ in the lower performance assuring temperature of the recording device. Also, the temperature in the circumference of the heat generating resistor or the heat sensitive resistance layer can be sensed, and $d_t$ can be changed in correspondence to this temperature. When the block is driven such as in FIG. 24, in comparison with the case that the block has been driven with the timing such as shown in FIG. 22, the driving of all blocks can be completed in a short time, allowing for high speed recording.

When the division drive has been carried out in the time shift $d_t$, which is a sufficiently short time in comparison with the applied pulse width (the time from $t_{on}$ to $t_{off}$), an advantage in the fidelity of the recording, as described as follows, other than the advantage to make the electric source efficient is obtained.

Taking the thermal head as an example, although a plurality of heat generating resistors are arranged linearly, and recording is carried out by continuously and relatively providing the heat sensitive recording paper sheet in a perpendicular direction, for example, when a straight line of the line width corresponding to one dot in the direction of the row of the heat generating resistors is intended to be recorded, if the shift time $d_t$ of the block division is so long as to not be neglected in comparison with the time in which the heat sensitive paper sheet relatively travels the distance of the line width corresponding to the one dot, the straight line becomes a step-like line corresponding to the position of the block. However, in the above-described driving method in which $d_t$ has been shortened and the division number has been increased, the step-like difference becomes slight in correspondence to the shortness of $d_t$, and is represented as a straight line in which the step difference is not prominent. Therefore, the method of the present invention is extremely useful for use as a plotter.

The substance for effecting the above-described one series of metal/non-metal (insulator/semiconductor) transition may comprise vanadium compounds.

By doping a minute amount of Chromium in vanadium oxide, the change of the electrical conductivity corresponding to metal/non-metal (insulator/semiconductor) is generated in a region of temperature above that of room temperature. At the higher temperature side, non-metallic electrical conductivity is obtained, and at the lower temperature side metallic electrical conductivity is obtained. Both vanadium and vanadium oxide are high melting-point substances, and may be used as a heat generating resistor. Film formation by the thin film process of sputtering may be used for producing a heat generating resistance film. The production by the thick film process in which the compound is made as a powder and is mixed with a binder, or is made into an organic metal compound to be mixed with a binder is also possible. In the above-described 8th embodiment the embodiment in the current passing heat recording, particles in which the particle diameter is properly arranged uniformly to be about the thickness of the heat generating resistance layer are used. In any of the above-described cases, the component of the vanadium oxide formed into a film or properly arranged in the particle size requires at least a polycrystalline structure. In the case of sputtering, the method in which an alloy target of metallic vanadium and chromium, or a metallic vanadium target mixed with chromium is sputtered by use of argon and oxygen gas. The method in which a target formed by sintering the mixture of vanadium oxide powder and chromium oxide powder by use of argon gas or by use of argon gas mixed with a minute amount of oxygen in carrying out sputtering can be used. In any of the sputtering processes, although it is desirable that the temperature of the film adhering part be above several hundred degrees C, there is also a method for increasing the crystallizing properties by carrying out laser irradiation after the film formation, or by carrying out vacuum annealing heat treatment.

When a suitable amount of Chromium has been doped, the electrical conductivity changes by 2 to 3 orders; when the device is used as a heat generating resistor and the heat generating resistance layer of a current passing heat sensitive paper, the consumption electric power value changes by 2 to 3 orders. For the heat recording, this accomplishes substantially the change in heat generation/non-heat generation required. Therefore, when it is inserted in parallel in an ordinary resistor such as tantalum nitride, thermet, etc., the heat generating resistors of the above-described one series of embodiments can be realized.

When the ratio of Chromium for doping in the above-described vanadium oxide is changed, it is possible to change the transition temperature, and the setting of the temperature of the series of intermediate temperatures $T_c$ becomes possible. In the vanadium oxide not doped with Chromium, although the ratio of the resistance value change is little, and is a mild change for the temperature, at about 400° C. there is the temperature rise of nearly one order. This vanadium oxide can be used in the heat generating resistor of such a solitary material constitution as in the first embodiment according to the present invention, and is also possible as a heat generating resistor material combined with an ordinary resistor material. For example, in the above-described second embodiment, although the first resistor and the second resistor have been provided as different layers of the resistance films, if the phase transition material such as vanadium oxide, etc. can preserve its phase transition characteristics in a film of mixed structure with another metal (for example, tantalum), a heat generating resistor can be formed as a mixed film. In this case, the product becomes a solitary heat generating resistor film which is the same as that in the above-described first embodiment, and the simplification of the processing such as the film formation of the heat generating resistor and patterning can be obtained.

Figure 25:
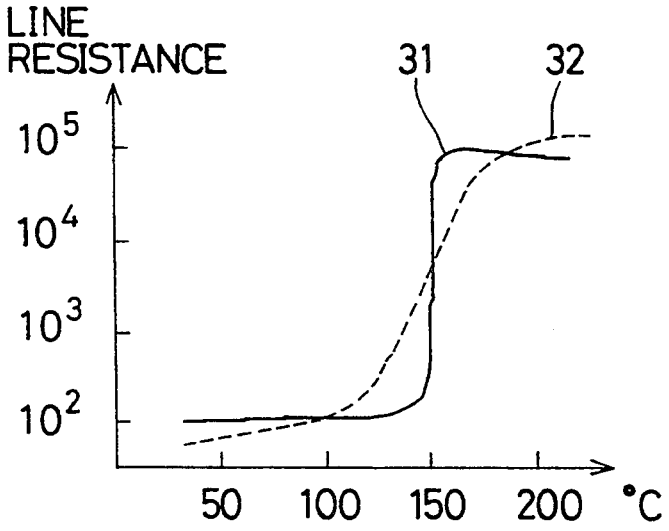
FIG. 25 is a diagram representing the resistance value characteristics of the resistor constituting the heat generating resistor according to the present invention.

FIG. 25 is a diagram representing the temperature change of the line resistance of the heat generating resistor for carrying out the metal/non-metal transition in the above-described first embodiment. Since the line resistance itself changes with the film thickness and the line width, although it is a reference value, in vanadium oxide doped with about 0.5% Chromium there is a resistance value change of about 3 orders at about 150° C., as shown in the line resistance characteristics curve 31 of FIG. 25. The temperature region for generating resistance value change varies by the dope amount of Chromium, and when the dope amount of Chromium is increased, the temperature region of the above-described resistance value change is gradually shifted to the low temperature side. When the dope amount of Chromium to vanadium exceeds several percent, since the change of the resistance value increase from the low temperature side toward the high temperature side is extinguished, the object of the device according to the present invention becomes difficult to attain. As described above, since the dope amount of Chromium makes the temperature characteristics of the resistance change occur, due to the microscopic non-uniformity in the sample of the dope amount of Chromium for vanadium, the change of the above-described line of resistance becomes a gently sloping one having a certain temperature width such as, for example, that shown as reference numeral 32 in the curve of Fig. 25. Even with such a gently sloping change, the object of the function of the device according to the present invention is attained. Also, for example, when the current is passed to the heat generating resistor having one edge of several mm to make it effect a temperature rise, since the temperature rise is not generated spatially uniformly in the heat generating resistor (for example, when the above-described substance has been used in the heat generating resistor of a thermal head), although the change of the resistance value as a heat generating resistor becomes apparently a gently sloping one as shown in FIG. 25 at reference numeral 32, in this case as well, there is microscopically generated a quick temperature rise up to the above-described intermediate temperature $T_c$ and a mild temperature rise in the temperature above $T_c$. Therefore, in order that the part where the temperature rise is slow continues to have a quicker temperature rise, the present invention has the function of correcting the temperature distribution in the heat generating resistor to a more uniform direction, and in comparison with the conventional heat sensitive recording method, has the advantage that a recording having higher fidelity of recorded dots can be realized.

In all of the above-described embodiments, the intermediate temperature $T_c$, where the temperature rise speed of the heat generating temperature rise process of the heat generating resistor does not change even when the recording medium such as the heat sensitive paper and the like, which are the heat absorption source is or is not contacted on the heat generating resistor, since the above-described intermediate temperature carries out milder temperature change, the deterioration and destruction of the heat generating resistor by an abnormal temperature rise of the heat generation peak temperature in the no-paper-supplied state of the heat generating resistor in the thermal head in the conventional heat recording device does not occur in the heat generating resistor of the recording device according to the present invention. Also, high reliability is realized for situations such as erroneous performance, reckless driving, etc. of the driving control circuit and CPU due to noise, etc.

In addition, the danger of generating in the current passing heat recording abnormal heat generation due to circuit reckless running, etc., combustion, and destruction of the device parts such as the platen and the like is prevented, and thus the reliability and safety of the device is enhanced.

In all embodiments, with respect to the resistance characteristics of the heat generating resistor, the heat sensitive resistance layer, etc., it is not necessary that the electric conductivity change discontinuously in a specially specified temperature, and it is of no matter that it carries out continuous temperature change in a temperature region having a specified width. As the resistance value of the above-described heat generating resistor changes, when there is a change of about 1.5 times to 10 times, there is displayed a sufficient effect. This change amount means the real ratio of the resistance value for bringing in the electric current consumption (energy) which can reach a temperature necessary for the temperature rise by heat generation to the recording, and the resistance value of such a degree that the electric power consumption (energy) at least maintains the temperature of the heat generating resistor and the heat-sensitive resistance layer.

As has been described above, according to the present invention, temperature control having more uniformity and reproducibility becomes possible, and recording of high quality with uniformity and improved reproducibility becomes possible. Also, the fluctuation of the thermal characteristics are suppressed so as to suppress the fluctuation of the recording characteristics. Further, the fluctuation of the heat generating resistor resistance values and the sheet resistance values of the heat sensitive resistance layer are suppressed so as to suppress the fluctuation of recording. Concentration harmonious control of high precision and net point harmonious control are easy to obtain. Temperature information collecting circuits, such as for temperature detection, etc., and the recording concentration correcting circuit in the recording device can be simply carried out, and it is possible to provide a device having a small size and inexpensive price. The device has high reliability and safety with regard to reckless running of the device. The heat generating temperature distribution is faithful to the heat generating resistor shape, and has excellent recording quality. Also, according to the driving method of the present invention, the electric source capacity can be made small. High speed recording is possible, and the recording of a straight line by a heat generating resistor row or a current passing electrode row can be faithfully carried out.

We claim:

1. A method of driving heating resistors in a thermal recording apparatus, comprising the steps of: dividing a plurality of heating resistors into a plurality of blocks, each of the heating resistors having an electrical resistance value which changes from a first lower resistance value in a lower temperature range to a second higher resistance value in a higher temperature range in a stepped manner during supply of a constant voltage pulse; and driving the plurality of heating resistors in the plurality of blocks by sequentially applying a pulse to each of the blocks to generate heat sequentially so that a current which is generated in the heating resistors by application of a constant voltage pulse changes from a first state with a large current to a second state with a small current in a stepped manner within a pulse application time, and the plurality of blocks are sequentially driven so that the first state with a large current within the pulse application time of one of the blocks does not overlap with the first state within the pulse application time of another one of the blocks.

2. A method of driving heating resistors in a thermal recording apparatus according to claim 1; wherein the plurality of blocks are sequentially driven so that the second state with a small current within the pulse application time of one of the blocks overlaps with the first state with a large current within the pulse application time of a block which is next applied with a pulse.

3. A thermal recording apparatus, comprising: a plurality of heating resistors divided into a plurality of blocks of heating resistors, the heating resistors each having an electrical conductivity characteristic having a first current consumption state corresponding to a steep temperature rise and a second current consumption state corresponding to a mild temperature rise; and driving means for driving the plurality of blocks of heating resistors by sequentially applying a constant voltage pulse to each of the blocks of heating resistors to generate heat, wherein each respective block has a first current consumption state with a relatively large current consumption and a second current consumption state with a relatively small current consumption state, the driving means being effective to drive each of the blocks of heating resistors so that the first current consumption state of each block does not overlap with the first current consumption state of another block.

4. A thermal recording apparatus according to claim 3; wherein the driving means includes means for driving the plurality of blocks so that the second current consumption state of one block overlaps with the first current consumption state of another block which is next applied with a pulse.

5. A method for driving a plurality of heating resistors in a thermal recording apparatus, comprising the steps of:

providing a plurality of heating resistors each having an electrical resistance value which changes from a first lower resistance value in a lower temperature range to a second higher resistance value in a higher temperature range in a stepped manner during supply of a constant power pulse;

dividing the plurality of heating resistors into a plurality of blocks of heating resistors, each of the blocks comprising at least one heating resistor;

applying a constant voltage power pulse to a certain heating resistor of a certain block to cause a current to flow therethrough such that the current value thereof changes from a first large current consumption state to a second small current consumption state in a stepped manner during supply of the constant voltage power pulse; and driving the plurality of blocks sequentially to cause a first large current consumption state of a heating resistor of one block not to overlap with a first large current consumption state of a heating resistor of another block.

6. A method for driving a plurality of heating resistors in a thermal recording apparatus according to claim 5; wherein the plurality of blocks are sequentially driven so that a second small current consumption state of a heating resistor of one block overlaps with a first large current consumption state of a heating resistor of another block which is next applied with a power pulse.

* * * * *